US012559816B2

(12) United States Patent
Pasquinet

(10) Patent No.: US 12,559,816 B2
(45) Date of Patent: Feb. 24, 2026

(54) RAPID COOLING OF HIGH YIELD STRENGTH SHEET STEEL

(71) Applicant: FIVES STEIN, Maisons-Alfort (FR)

(72) Inventor: Catherine Pasquinet, Maisons-Alfort (FR)

(73) Assignee: FIVES STEIN (FR)

( * ) Notice: Subject to any disclaimer, the term of this patent is extended or adjusted under 35 U.S.C. 154(b) by 254 days.

(21) Appl. No.: 17/768,688

(22) PCT Filed: Sep. 30, 2020

(86) PCT No.: PCT/FR2020/051716

§ 371 (c)(1),
(2) Date: Apr. 13, 2022

(87) PCT Pub. No.: WO2021/074500

PCT Pub. Date: Apr. 22, 2021

(65) Prior Publication Data

US 2024/0026490 A1 Jan. 25, 2024

(30) Foreign Application Priority Data

Oct. 14, 2019 (FR) ..... 1911391

(51) Int. Cl.
*C21D 9/573* (2006.01)
*B21B 37/44* (2006.01)
(Continued)

(52) U.S. Cl.
CPC ..... *C21D 9/573* (2013.01); *B21B 37/44* (2013.01); *C21D 1/18* (2013.01); *C21D 1/60* (2013.01);
(Continued)

(58) Field of Classification Search
CPC . C21D 1/18; C21D 1/60; C21D 1/613; C21D 1/667; C21D 11/005; C21D 9/0062; C21D 9/573; C21D 6/00
See application file for complete search history.

(56) References Cited

U.S. PATENT DOCUMENTS 6,368,430 B1 4/2002 Bennon et al.
2011/0262877 A1* 10/2011 Katsumata ..... F27B 9/02 432/77
(Continued)

FOREIGN PATENT DOCUMENTS

CN 104812918 A 7/2015
EP 0970260 A1 1/2000
(Continued)

OTHER PUBLICATIONS

Lazardis, N.A. et al. "Continuous heat treating of sheet steel." 1984. Mat. Res. Soc. Symp. Proc. (21). p.781-788. (Year: 1984).*
(Continued)

*Primary Examiner* — Nicholas A Wang
(74) *Attorney, Agent, or Firm* — The Belles Group, P.C.

(57) ABSTRACT

Method for reducing unevenness in a strip subjected to cooling by spraying of liquid, or a mixture of gas and liquid, along a cooling zone of a continuous heat treatment one, the cooling intensity being adjusted in the direction of travel of the strip so as to achieve a relative position between the Leidenfrost temperature and at least one temperature at which the metallurgical structure changes such that said cooling intensity minimizes the internal stresses of the strip, and device for implementing the method.

10 Claims, 7 Drawing Sheets

(51) Int. Cl.

| | |
|---|---|
| ***C21D 1/18*** | (2006.01) |
| ***C21D 1/60*** | (2006.01) |
| ***C21D 1/613*** | (2006.01) |
| ***C21D 1/667*** | (2006.01) |
| ***C21D 9/00*** | (2006.01) |
| ***C21D 11/00*** | (2006.01) |

(52) U.S. Cl.

CPC ..... *C21D 1/613* (2013.01); *C21D 1/667* (2013.01); *C21D 9/0062* (2013.01); *C21D 11/005* (2013.01); *C21D 2211/008* (2013.01)

(56) References Cited

U.S. PATENT DOCUMENTS

| | | | | |
|---|---|---|---|---|
| 2011/0270433 | A1* | 11/2011 | Claveroulas | C21D 9/56 700/110 |
| 2014/0367898 | A1* | 12/2014 | Hebert | C21D 9/0068 266/44 |
| 2015/0218759 | A1 | 8/2015 | Pointner et al. | |
| 2016/0304984 | A1* | 10/2016 | Genaud | C21D 6/00 |

FOREIGN PATENT DOCUMENTS

| | | | |
|---|---|---|---|
| EP | 1108795 | A1 | 6/2001 |
| FR | 2940978 | A1 | 7/2010 |
| JP | 2000-42621 | A | 2/2000 |
| JP | 2004331992 | A | 11/2004 |
| JP | 2013-181226 | A | 9/2013 |
| JP | 2013181226 | * | 9/2013 |
| JP | 2015055002 | A | 3/2015 |
| WO | WO2019079763 | * | 4/2019 |

OTHER PUBLICATIONS

Li, D. "Boiling water heat transfer during quenching of steel plates and tubes." 2003. University of British Columbia. (Year: 2003).*

G.E. Totten, J.L. Dossett, N.I. Kobasko, Quenching of Steel, Steel Heat Treating Fundamentals and Processes, vol. 4A, ASM Handbook, Edited By Jon L. Dossett, George E. Totten, ASM International, 2013, p. 91-157, https://doi.org/10.31399/asm.hb.v04a.a0005824 (Year: 2013).*

Rodrigues, R. et al. "Technical feasibility study for extending the speed limit of a continuous steel production line aiming at increasing its productivity." 2013. (Year: 2013).*

* cited by examiner

[Fig. 1]
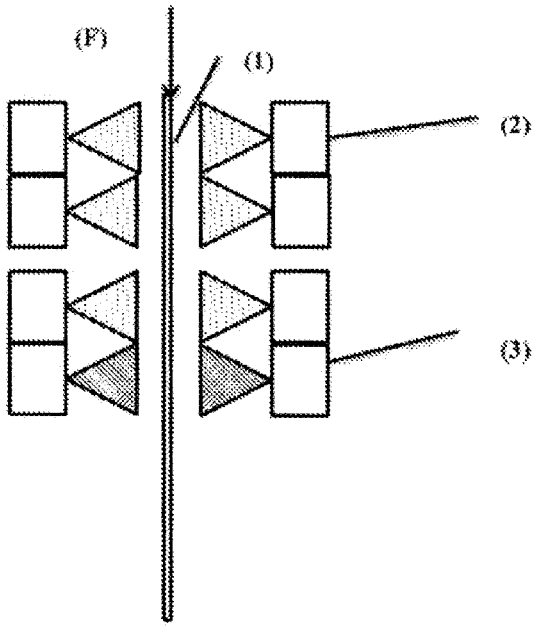
[Fig. 2]
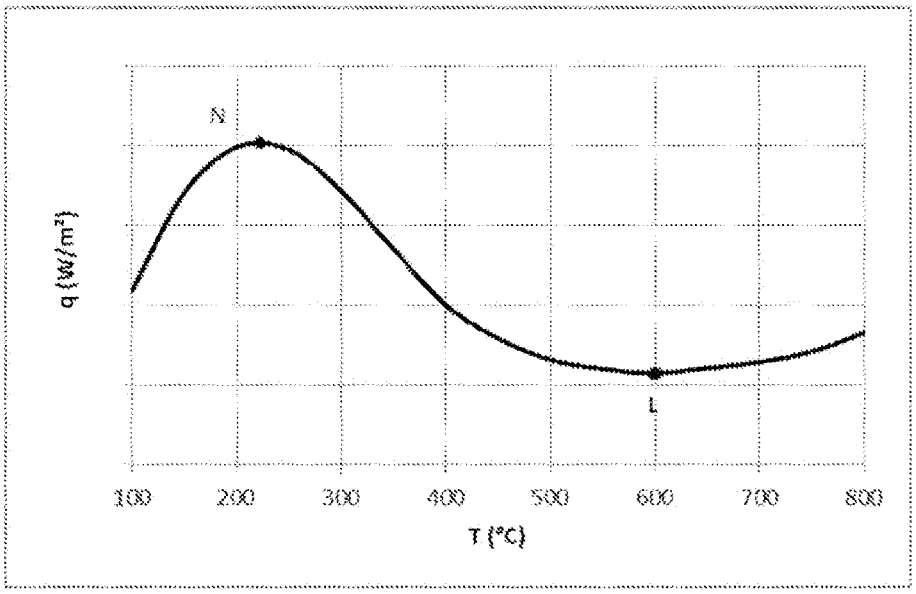

[Fig. 3]
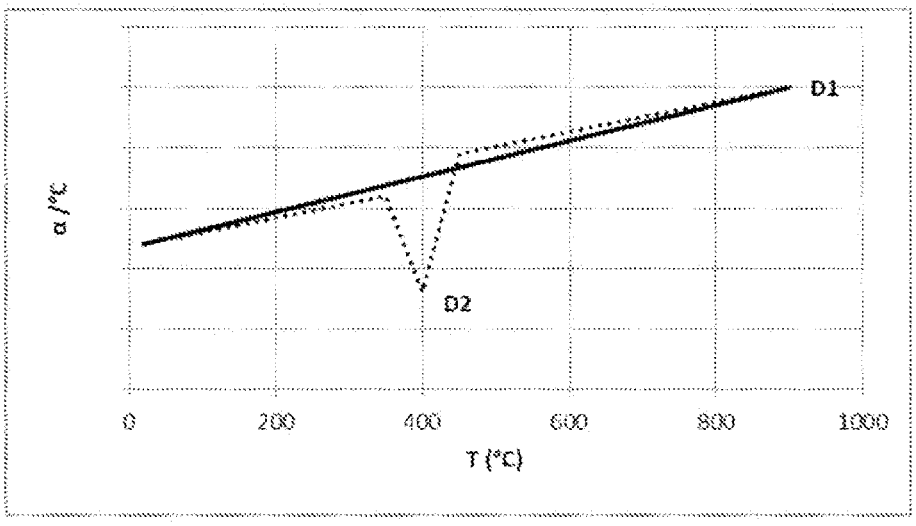
[Fig. 4]
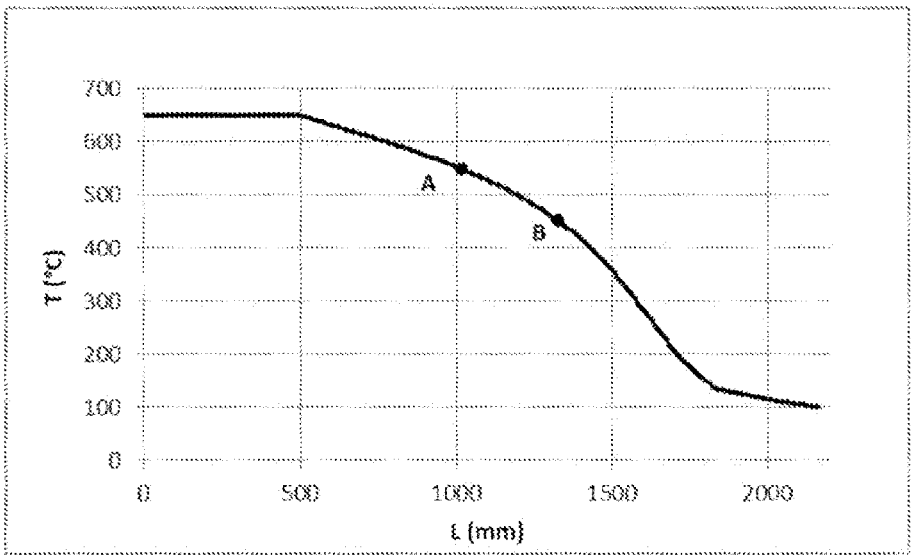

[Fig. 5]
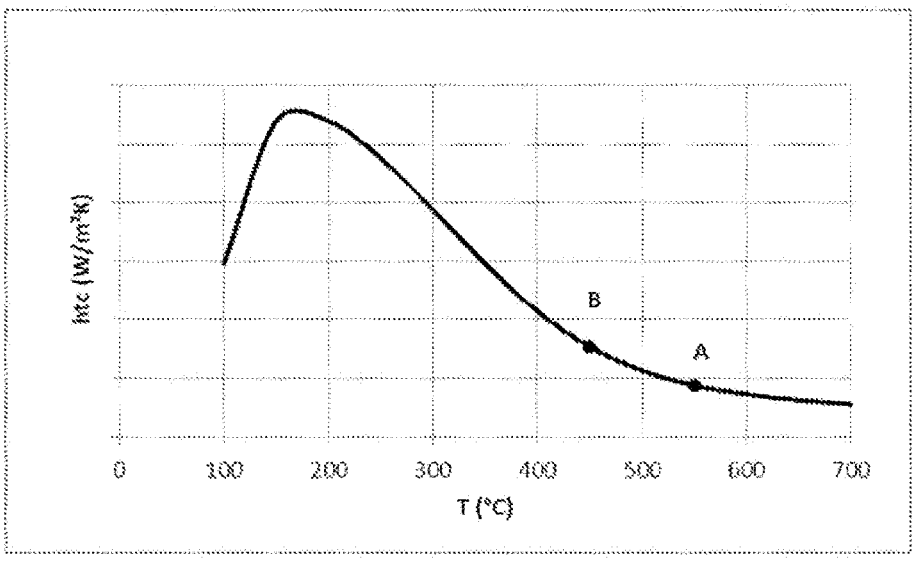
[Fig. 6]
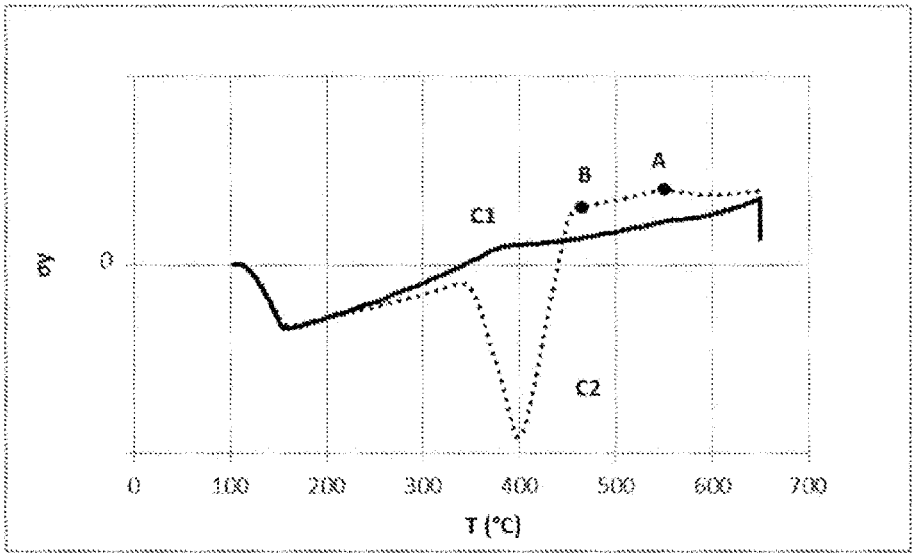

[Fig. 7]
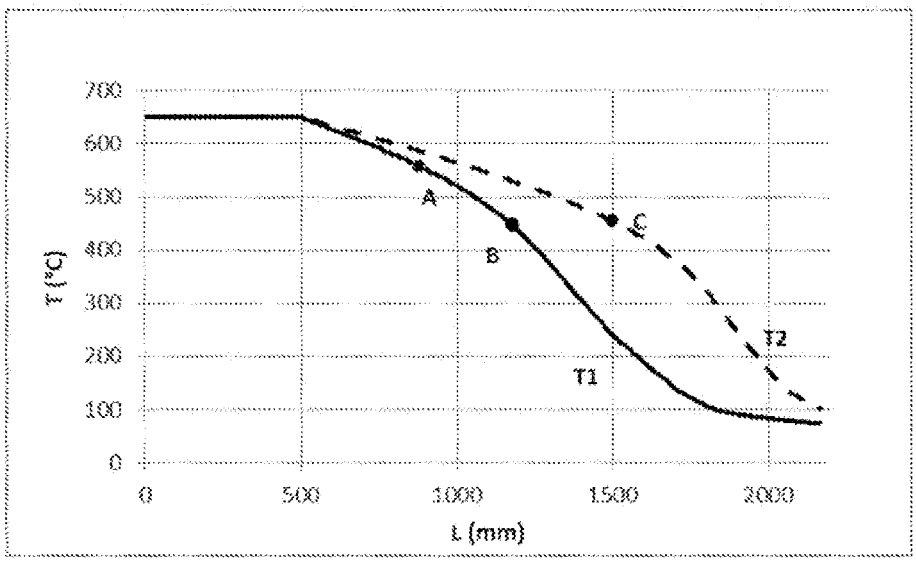
[Fig. 8]
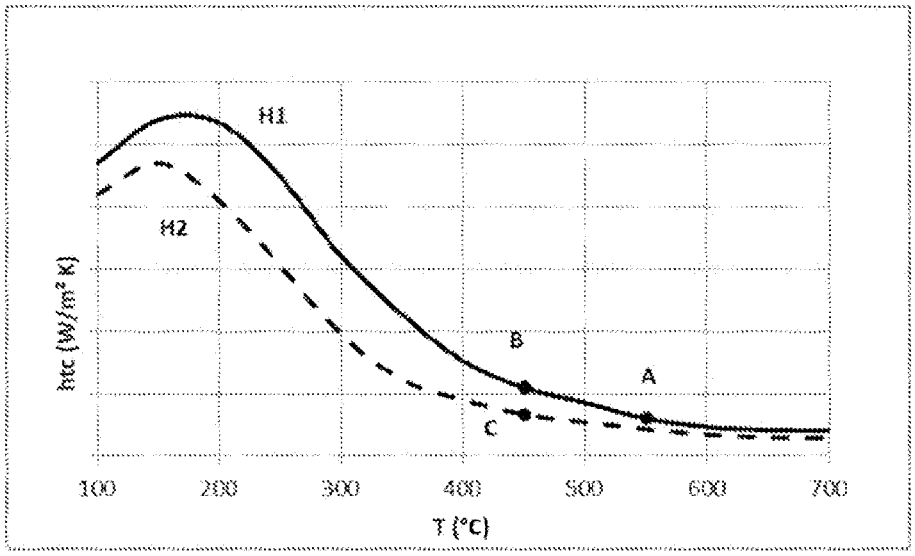

[Fig. 9]
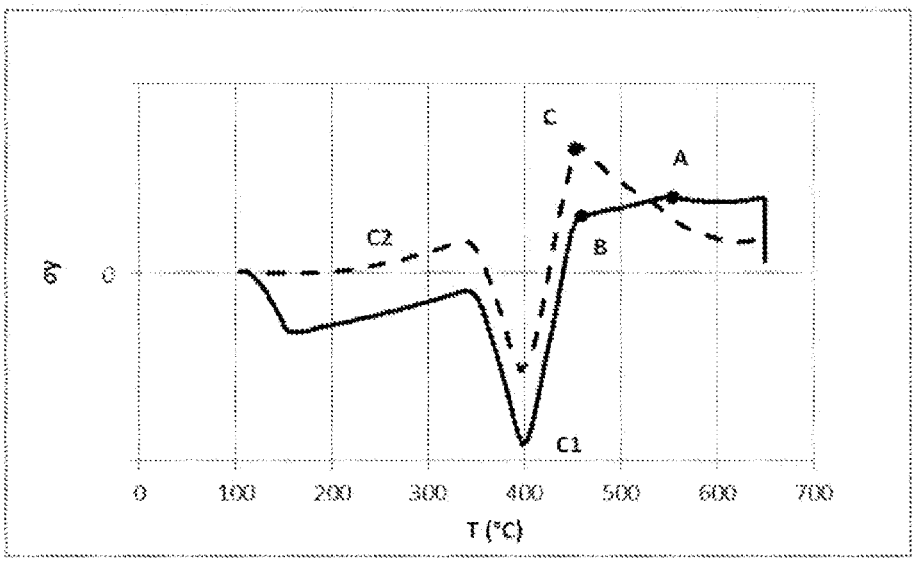
[Fig. 10]
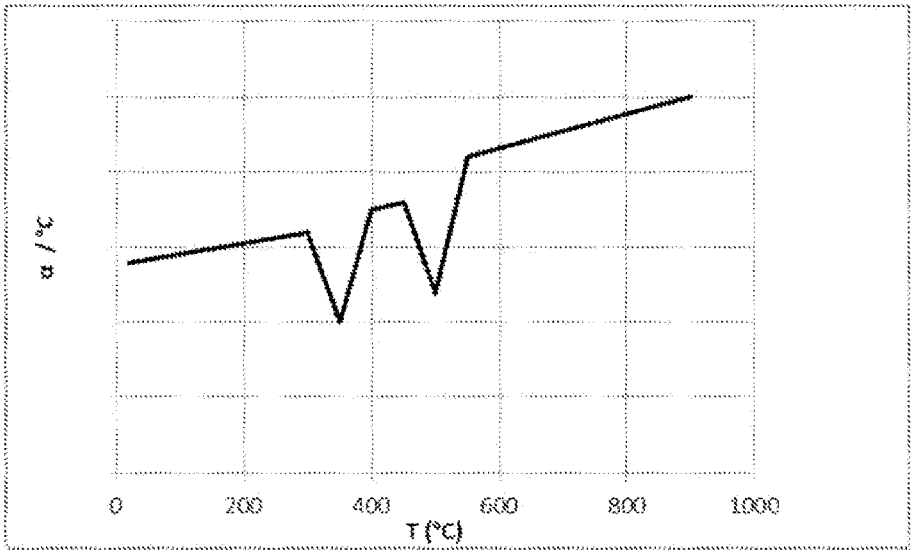

[Fig. 11]
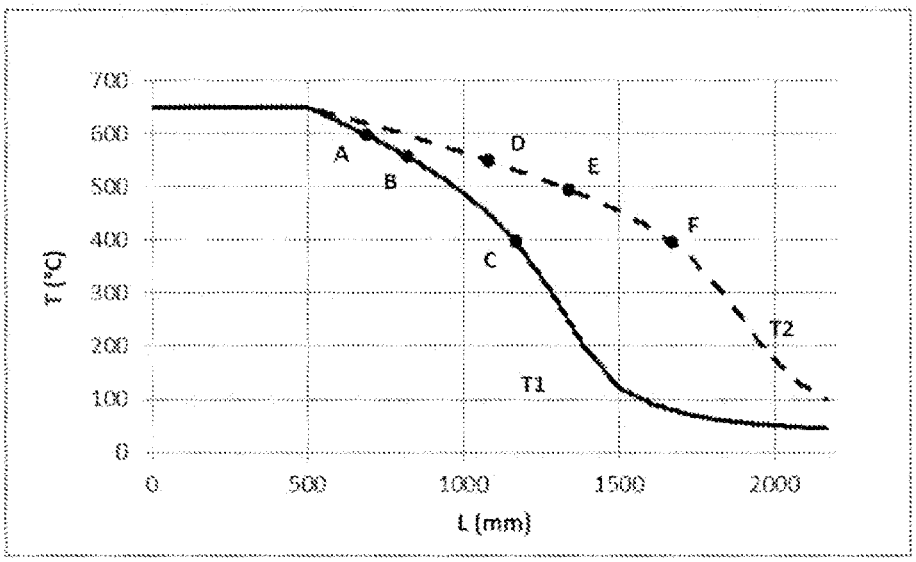
[Fig. 12]
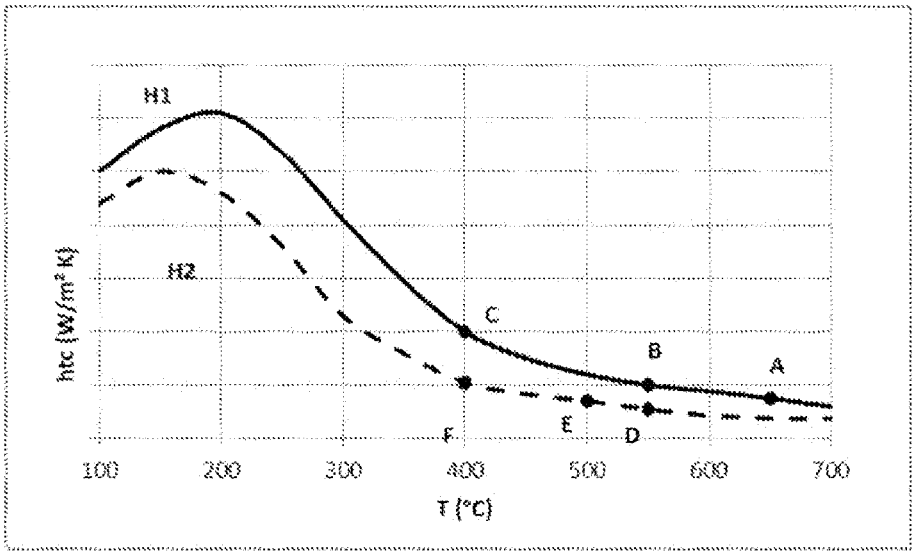

[Fig. 13]
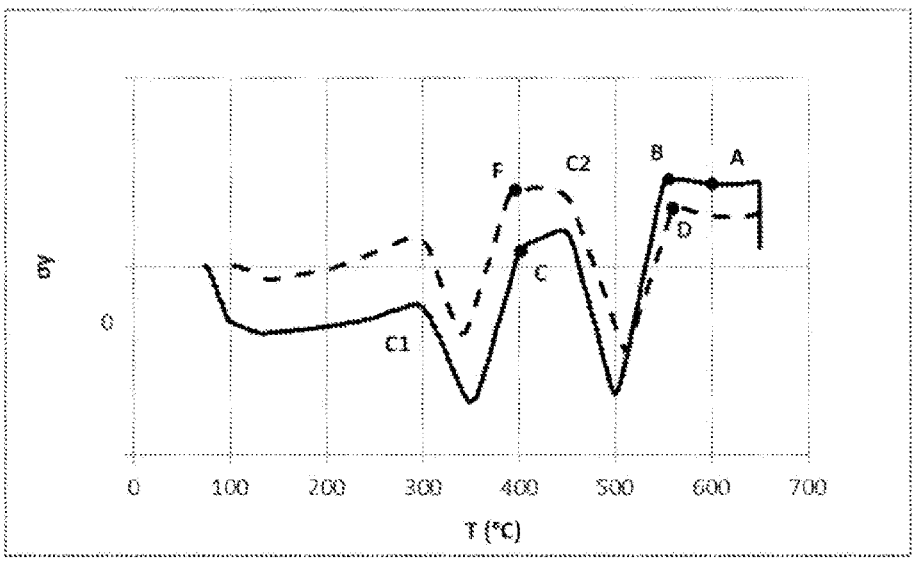

RAPID COOLING OF HIGH YIELD STRENGTH SHEET STEEL

CROSS-REFERENCE TO RELATED PATENT APPLICATIONS

The present application is a U.S. national stage application under 35 U.S.C. § 371 of PCT Application No. PCT/FR2020/051716 filed Sep. 30, 2020, which claims priority to French Patent Application No. 1911391 filed Oct. 14, 2019. The disclosures of the aforementioned priority applications are incorporated herein by reference in their entireties.

DESIGNATION OF THE TECHNICAL FIELD CONCERNED

The invention relates to continuous lines for producing metal strips. It relates more particularly to the rapid cooling sections of annealing or galvanizing lines for steel strips in which the strip is cooled at cooling rates greater than 100° C./s, by spraying liquid or a mixture of liquid and gas.

The development of new steels with a very high yield strength, typically greater than 500 MPa, required by car manufacturers to develop lighter structures with high mechanical strength, in accordance with environmental constraints, requires heat treatments with cooling rates exceeding 100° C./s to establish complex structures with a variable distribution of different metallurgical phases among the austenitic, ferritic, pearlitic, bainitic and martensitic phases.

In particular, AHSS and UHSS steels with very high yield strengths may be produced by controlling the cooling rates in the continuous annealing lines, from a totally austenitic or a mixed ferritic and austenitic metallurgical structure.

The heat treatment to be applied in the continuous line depends on the chemical composition of the steel, its condition at the start of the line, and the mechanical properties expected at the end of the treatment. It comprises a heating step up to a temperature at the end of heating of between 750 and 950° C., a holding time at the temperature reached at the end of heating and cooling down to ambient temperature or an intermediate temperature with a specific cooling rate for each metallurgical grade.

For example, obtaining a given steel may require an annealing temperature higher than its austenitizing temperature, then a holding time at this temperature, followed by slow cooling for a partial transformation of the austenite into ferrite and finally rapid cooling for transformation of the austenite into martensite.

The mechanical properties achieved at the end of the treatment depend on the chemical composition of the steel and the control of the thermal process to obtain a particular microstructure. The quality of the products at the end of the treatment, that is to say, the uniformity of the mechanical properties and the flatness of the strip, depends on the type of cooling among the types of cooling usually used for these heat treatment methods, namely cooling by gas jet, cooling by spraying liquid or gas and liquid mixture, and cooling by quenching. Cooling may optionally be followed by a tempering or aging step.

Technical Problems Addressed by the Invention

The rapid cooling step may cause unevenness defects of the strip of variable type and amplitude depending on the cooling method applied.

The common unevenness defects encountered during the heat treatment of metal strips are of the type of undulations in the direction of travel for moderate cooling by gas jets on thin strips, that is to say, for cooling speeds of less than 100° C./s.

The defects are of the long edges or long center type for rapid cooling by gas jets or by spraying of liquid or by spraying of a mixture of gas and liquid, that is to say, for cooling rates of about 100 to 500° C./s. The defects are of the dispersed blister type for very rapid cooling rates by spraying liquid or mixture of gas and liquid or cooling by quenching, that is to say, for cooling rates greater than 500° C./s. The unevenness defects observed result from the development of internal stresses in the strip developed during cooling.

The stresses causing unevenness defects depend on:

- the geometry of the product, i.e. the width, the thickness and the initial unevenness,
- the temperature distribution in the product, in the direction of travel, in the width of the product and possibly in the thickness of the product for thick strips,
- transformations of metallurgical phases,
- variations in the thermophysical properties of the product as a function of the variation in temperature during the heat treatment.

The distribution and amplitude of the stresses that condition the type and amplitude of the defects observed depend on the grade of the steel and the distribution of the metallurgical phases during the rapid cooling step of the heat treatment method.

For example, for a grade of steel known to those skilled in the art as dual-phase, of mixed austenitic and ferritic structure, with a variable proportion of austenite before the rapid cooling stage, the risk of unevenness defect that results from the thermal heterogeneity and the transformation heterogeneity from the austenitic phase to the martensitic phase increases with the proportion of austenite available at the onset of rapid cooling.

TECHNICAL BACKGROUND

According to the state of the art, different technologies may be used to rapidly cool steel strips in a continuous line. Cooling by gas jet with a variable hydrogen content allows cooling slopes to be obtained of up to 200° C./s. Cooling in contact with a liquid allows slopes to be obtained greater than 200° C./s according to 3 types of technology:

- cooling by spraying a mixture of gas and liquid by means of bi-fluid nozzles,
- cooling by spraying a liquid using mono-fluid nozzles,
- quenching by immersion in a liquid, possibly combined with liquid spraying.

According to the state of the art, several methods may be applied to reduce the unevenness defects that result from the stresses induced by the thermal slope breaks observed in the direction of travel of the product, independent of the gas jet cooling technology, by spraying liquid or by spraying a mixture of gas and liquid.

Breaks in the direction of travel of the product, regardless of the fluid used, have multiple origins:

- the increase in the cooling slope at the entrance to the rapid cooling section,
- the cooling discontinuity between 2 successive cooling zones,
- contact with drive or stabilizing rollers.

For cooling by spraying liquid or a liquid and gas mixture, the Leidenfrost phenomenon, which consists of a sudden increase in the heat transfer coefficient by convection during the transition between the vapor phase cooling regime and the phase cooling regime liquid, also creates a cooling discontinuity in the direction of travel of the product.

During the rapid cooling step of the heat treatment method, the strip therefore undergoes a succession of internal tensile or compressive stresses that may cause the appearance of a phenomenon of irreversible deformation of the products if the stresses are high enough.

The type of deformation that results from this discontinuity is of the undulation type in the direction of travel of the product.

EP1108795 by the applicant describes a method for reducing the risk of unevenness in gas jet cooling sections by modulating the cooling between successive cooling boxes in order to reduce slope breaks. This method applies to cooling by gas jet considered to be perfectly homogeneous across the width of the product and to grades without metallurgical phase transformation in the temperature range concerned by the cooling method, for example conventional steels with a totally ferritic structure.

According to the state of the art, several methods may be applied to reduce unevenness defects that result from a temperature difference observed in the direction of the width of the product, for example the edges of the product colder than the center, or the center of the product colder than the edges. The differences in thermal efficiency across the width of the product, regardless of the fluid used, have multiple origins:

the differential flow of the fluid between center and edges,
the initial unevenness defect,
imbalance of gas or fluid distribution,
the vibration of the strip.

FR2940978 by the applicant, which has in particular for counterpart publication US20110270433A1, describes a method for controlling the homogeneity of the cooling by spraying a liquid or a mixture of gas and liquid along the width and/or the length of a metallic strip, by determining the zone where the vapor film disappears and adapting the cooling parameters such as the temperature of the liquid, the speed, the flow rate or the size of the drops and the gas flow rate for cooling by spraying a mixture of gas and liquid in order to maintain the vapor phase at all points. This patent does not take into account the metallurgical transformations during cooling and the impact thereof on the flatness of the strip. Thus, nothing is said about the modifications of the metallurgical structure (the nature and the proportions of the phases) that result from the changes made to the cooling parameters.

This method, which keeps spray cooling in the vapor film phase, and is inefficient in terms of heat exchange, does not make it possible to achieve the cooling slopes required to produce very high yield strength steels.

The solutions according to the state of the art propose an improvement in the flatness of the products by reducing the internal stresses that result from a temperature distribution that is discontinuous in the direction of travel and non-uniform in the width of the products.

These solutions are not sufficient for the heat treatment of very high yield strength steels, in particular steels with metallurgical phase change during the rapid cooling method such as Dual Phase steels, TRIP steels, or martensitic steels. These steels require rapid cooling with slopes greater than 200° C./s by spraying liquid or a liquid and gas mixture from a temperature of 780 to 850° C. at the end of holding after heating or a temperature of about 650 at 750° C. after a first slow cooling stage, down to a temperature at the end of cooling of about 400 to 50° C. depending on the grade.

The particularity of liquid spray cooling is based on the observation of three successive cooling regimes:

For high temperatures of the cooled surface, typically above about 600° C., we have vapor film cooling. A layer of vapor completely insulates the strip from contact with the liquid, which leads to a stable and low heat exchange coefficient.

For intermediate temperatures define a transition range, typically between about 600° C. and 200° C., the cooling regime is unstable and a strong variation in the heat exchange coefficient is observed.

For lower temperatures, i.e. typically between about 200° C. and 100° C., we have cooling in the nucleate boiling regime, with a rapid decrease in the heat exchange coefficient when the temperature of the surface decreases.

For low temperatures, typically below 100° C., the cooling regime is a convection regime.

The Leidenfrost temperature, represented by point L on the graph in appended FIG. 2, is the temperature that separates the stable vapor film cooling range from the unstable transition range. The temperature represented by the letter N on the graph delimits the transition range and the cooling range in the nucleate boiling regime.

Local thermal instability in the transition zone between vapor phase cooling and liquid phase cooling, usually observed between 200 and 600° C., can cause unevenness defects in response to local thermal heterogeneity and desynchronization of phase transformations in the different parts of the strip.

Metallurgical phase transformation stresses that result from the discontinuity of the physical properties of the products are then superimposed on the differential expansion stresses that result from the thermal gradients in the direction of travel of the product and in the width of the product.

In particular, the slope breaks that are visible on the evolution curve of the expansion coefficient linked to the variation in volume of the metallurgical phases in the temperature range concerned by the rapid cooling method generate stresses at the origin of the unevenness defects observed for very high yield strength steels with a complex metallurgical structure.

The methods for reducing the stresses of thermal origin that result from the temperature distribution heterogeneity in the direction of travel and in the direction of the width of the product are not sufficient to guarantee the flatness required for the use of the products treated, especially for automobile construction.

The desynchronization of the metallurgical phase transformations associated with low-amplitude temperature variations causes internal stresses high enough to observe local irreversible deformations.

DISCLOSURE OF THE INVENTION

The invention proposes an improvement in the flatness of very high yield strength steels in the rapid cooling method by spraying liquid or a mixture of gas and liquid by optimizing the relative position of the thermal and metallurgical critical points in order to reduce internal stresses resulting from coupled thermal and metallurgical phenomena.

To this end, according to a first aspect of the invention, there is proposed a method for reducing unevenness defects of a strip subjected to cooling by spraying liquid, or a mixture of gas and liquid, along a cooling zone of a continuous heat treatment line, said cooling zone having means for adjusting the cooling intensity along the cooling zone, the method comprising determining a thermal profile, i.e. a thermal evolution as a function of distance, to be applied to the strip by the cooling zone in the cooling direction, said thermal profile having a critical strip temperature, called Leidenfrost temperature, reached substantially concomitantly with a first metallurgical transformation temperature, or after the onset of a first and before the onset of a second metallurgical transformation temperature, and a step of applying said thermal profile determined by the adjusting means of the cooling zone.

The thermal profile is determined by calculation means. It may also comprise experimental means.

In the present description, the expression "metallurgical transformation" refers to a change in metallurgical structure.

With a method according to the invention, the cooling intensity is adjusted in the direction of travel of the strip so as to obtain a relative position between the Leidenfrost temperature and at least one metallurgical transformation temperature such that it minimizes the internal stresses in the strip.

There is thus a compensation effect that results from the superposition of thermal stresses and microstructure stresses.

According to the invention, the cooling intensity may be adjusted along the cooling zone:

- according to the minimum cooling rate to obtain a chosen metallurgical transformation, and/or
- such that a metallurgical transformation begins substantially at a selected temperature, and/or
- such that the Leidenfrost temperature is substantially equal to a chosen value, and/or
- such that the Leidenfrost temperature is substantially equal to a temperature at the onset of metallurgical transformation.

When the targeted metallurgical transformation is from austenite to martensite, the cooling intensity may be adjusted so that the Leidenfrost temperature is within a temperature range within plus or minus 50° C. of the martensitic transformation onset temperature.

When at least two metallurgical transformations are targeted, the cooling intensity may be adjusted so that the Leidenfrost temperature is at an intermediate temperature between a temperature at the onset of a first metallurgical transformation and a temperature at the onset of a last metallurgical transformation.

According to the invention, the cooling intensity may be adjusted by adjusting the cooling length and/or adjusting the flow rate and the pressure of the cooling liquid, or of the mixture of gas and liquid.

The proposed method to reduce the internal stresses and the risk of unevenness defect may be described as having four steps.

The first step is to calculate the minimum cooling rate to obtain the desired metallurgical transformation(s). In the case where only a transformation of austenite into martensite is sought, the minimum cooling rate is calculated that avoids a transformation into another phase, for example bainite.

The cooling rates necessary to obtain the required metallurgical microstructures depend on the composition of the steel, the annealing temperature and the holding time at the annealing temperature, According to the state of the art, the type of metallurgical transformation observed from a totally or partially austenitic structure obtained at the end of the holding zone depends on the cooling rate applied.

For slow cooling rates, less than 1° C./s, a transformation from the austenitic structure toward the ferritic and pearlitic structures is observed. For average cooling rates, below 25° C./s, a transformation from the austenitic structure toward the ferritic and bainitic structures is observed. For rapid cooling rates, greater than 100° C./s, a transformation from the austenitic structure toward the martensitic structure is mainly observed when the temperature at the end of cooling is lower than that at the onset of the martensitic transformation. The content of alloying elements, such as manganese, chromium or molybdenum, impacts these cooling rate thresholds.

The second stage consists in calculating the metallurgical transformation temperatures. The metallurgical transformations are accompanied by a strong variation of the mechanical and thermophysical properties, in particular a strong variation of the thermal expansion coefficient, Indeed, the transformations from the austenitic phase toward the ferritic, pearlitic, bainitic or martensitic phases are accompanied by a change in crystallographic structure and an increase in volume, which results in a reduction in the thermal expansion coefficient.

This break observed on the evolution curve of the thermal expansion coefficient during the cooling method generates internal stresses that result from the volume changes that accompany the phase changes.

The combination of this metallurgical phenomenon with the thermal heterogeneity resulting from the cooling method leads to a heterogeneous stress distribution, with alternating tensile stresses and compressive stresses at different points of the product.

The metallurgical transformation temperatures and the evolution of the expansion coefficient depend on the composition of the product and the annealing thermal cycle, which determines the percentage of austenite capable of being transformed and the cooling rate.

The metallurgical transformation temperatures and the evolution curves of the thermophysical properties during rapid cooling may be precisely determined by the usual laws available according to the state of the art from operating data such as the chemical composition of the products and the associated heat cycles. Typical values for the bainitic transformation temperature are between 600 and 400° C. Typical values for the temperature at which martensitic transformation begins are between 250 and 450° C.

The third step consists in determining the thermal critical points, in particular for rapid cooling methods by liquid spraying, for which the Leidenfrost phenomenon, which generates a strong increase in the exchange coefficient in the transition zone between vapor phase and liquid phase, is accompanied by a strong variation of the internal stresses in the strip.

The Leidenfrost temperature, which is the critical point of increase in the exchange coefficient between the strip and the fluid at the moment of rupture of the insulating vapor layer, depends on many parameters, in particular spray characteristics such as the speed and the diameter of the drops, the mesh size of the nozzles, the distance from the nozzles to the strip, the temperature and the nature of the fluid.

These parameters may be determined experimentally for different types of spray nozzles in order to constitute tables applicable to cases of industrial production.

Typical Leidenfrost temperature values are between 200° C. for the lowest sputtering velocities and 1000° C. for the highest velocities.

The fourth step consists in adjusting the cooling parameters. From the identification of the cooling slope defined in step 1, the identification of the metallurgical transformation critical temperatures defined in step 2 and strong breaks in the cooling slopes defined in step 3, an optimal adjustment of the cooling parameters is proposed in order to minimize compressive stresses at any point of the strip. This adjustment consists in modulating the thermal profile of the strip in order to obtain a relative position of the Leidenfrost transition and metallurgical transformation critical points that minimizes the internal stresses in the strip.

In particular, the displacement of the Leidenfrost transition temperature to a temperature lower than or equal to the most critical transformation temperature, i.e. the temperature that induces the greatest variation in volume during the phase transformation, allows limitation of the internal stresses that result from the non-synchronization of the particularly significant phase transformations in the thermally unstable Leidenfrost transition zone.

This optimum adjustment is obtained by adjusting the cooling length, adjusting the flow rate and liquid pressure for the case of liquid spray cooling, supplemented by adjusting the flow rate and pressure of the gas in the case of cooling by spraying a mixture of liquid and gas, within the range of flow rates and pressures available for each zone of the cooling section.

According to a possibility offered by the invention, the liquid, or the mixture of a gas and a liquid, may be chosen to be non-oxidizing for the strip. The liquid is for example an aqueous solution comprising 0.1% and 6% by mass of formic acid. The gas is for example nitrogen, or a mixture of nitrogen and hydrogen.

According to a second aspect of the invention, also proposed is a cooling zone of a continuous treatment line for metal strips, arranged to cool the strip by spraying it with liquid, or with a mixture of a gas and a liquid, by means of nozzles arranged on either side of the strip with respect to its travel plane, said cooling zone having means for adjusting the cooling intensity suitable for carrying out the steps of the method according to the invention.

According to one possibility, the cooling zone comprises at least two rows of nozzles arranged transversely to the travel plane of the strip, the second row of nozzles in the direction of travel of the strip having a spray rate greater than or equal to the first row.

The adjusting means may comprise means for adjusting the flow rate and the supply pressure of the nozzles in the length and/or the width of the product.

According to a third aspect of the invention, also proposed is a continuous heat treatment line, comprising a cooling zone according to the second aspect of the invention, or one or more of its improvements.

The line according to the invention may comprise means for calculating the minimum cooling rate to obtain a desired metallurgical transformation.

The line according to the invention may comprise means for calculating the metallurgical transformation temperatures of the strip as a function of its chemical composition and of the heat cycles applied.

The line according to the invention may comprise means for calculating the thermal profile of the strip along the cooling zone to determine the optimum cooling distribution along the latter. Means for adjusting the flow rate and the supply pressure of the nozzles, in the length and width of the product, allow this distribution to be obtained.

The line according to the invention may comprise an experimental database for determining the Leidenfrost temperature associated with each production case.

According to another aspect of the invention, a computer program product is proposed comprising instructions that lead a cooling zone according to the invention to execute the steps of the method according to the invention.

According to yet another aspect of the invention, a computer-readable medium is proposed, on which the computer program product according to the invention is recorded.

BRIEF DESCRIPTION OF THE FIGURES

Apart from the arrangements set out above, the invention consists of a certain number of other arrangements that will be more explicitly discussed below with regard to embodiments described with reference to the appended drawings, but which are in no way limiting. In these drawings:

FIG. 1 is a schematic view in longitudinal section of the strip in the cooling section according to an embodiment of the invention.

FIG. 2 is a graph of the evolution of the heat flux as a function of the surface temperature, representative of the liquid spray cooling method.

FIG. 3 is a graph of the evolution of the thermal expansion coefficient as a function of temperature, according to a first embodiment.

FIG. 4 is a graph of the evolution of the strip temperature in the direction of travel, for a uniform pressure distribution in the spray nozzles.

FIG. 5 is a graph of the evolution of the heat exchange coefficient corresponding to the thermal profiles of FIG. 3.

FIG. 6 is a graph of the evolution of the longitudinal stress at the edge of the strip, for the thermal profile corresponding to the thermal profile of FIG. 3

FIG. 7 is a graph of the evolution of the temperature of the strip in the direction of travel, for a uniform pressure distribution in the spray nozzles and an optimized pressure distribution in the spray nozzles according to a first embodiment FIG. 8 is a graph of the evolution of the heat exchange coefficient as a function of the temperature of the strip corresponding to the thermal profiles of FIG. 6.

FIG. 9 is a graph of the evolution of the longitudinal stress at the edge of the strip, for the longitudinal thermal profile corresponding to the thermal profiles of FIG. 6.

FIG. 10 is a graph of the evolution of the thermal expansion coefficient as a function of temperature, according to a second embodiment.

FIG. 11 is a graph of the evolution of the temperature of the strip in the direction of travel, for a uniform pressure distribution in the spray nozzles and an optimized pressure distribution in the spray nozzles according to a second embodiment.

FIG. 12 is a graph of the evolution of the heat exchange coefficient as a function of the temperature of the strip corresponding to the thermal profiles of FIG. 9.

FIG. 13 is a graph of the evolution of the longitudinal stress at the edge of the strip, for the longitudinal thermal profile corresponding to the thermal profiles of FIG. 9.

DETAILED DESCRIPTION OF THE INVENTION

According to a first embodiment, the rapid cooling zone of a continuous treatment line metal strips illustrated in FIG. 1 is arranged to cool the strip (1) by spraying it with a liquid, or with a mixture of a gas and a liquid, by means of nozzles arranged on either side of the strip with respect to its travel plane, and comprises, in the direction of travel (F) of the strip, three rows (2) of mono-fluid or bi-fluid nozzles, followed by a row of mono-fluid or bi-fluid nozzles with a range of spray flow rates greater than or equal to the previous one, the rows of nozzles being arranged transversely to the travel plane of the strip.

For carbon steel composed of 0.1% Carbon, 1% Manganese and 1% Silicon, annealed at a temperature above 850° C. for complete austenitization, cooled from 650 to 100° C. in a rapid cooling section by spraying with an average cooling slope of about 500° C./s, a single slope break may be observed at 450±15° C. on the evolution curve of the thermal expansion coefficient illustrated schematically by curve D2 in the attached FIG. 3, corresponding to the total martensitic transformation of the austenitic phase.

The minimum cooling rate for complete martensitic transformation, i.e. without transformation of austenite into another phase such as bainite or pearlite, may be determined from the transformation curves established for the composition of the steel, i.e. 200° C./s for the example considered.

The thermal profile illustrated by the curve in the appended FIG. 4 is obtained in a cooling section comprising 4 rows of nozzles for spraying liquid with a constant flow rate and pressure over the entire length of the cooling section, to cool a strip from 650 to 100° C. with an average cooling rate of 480° C./s for a strip traveling at 70 m/min. The critical points are located at 550° C. represented by point A, corresponding to the Leidenfrost temperature, and at 450° C. represented by point B, corresponding to the temperature at the onset of martensitic transformation.

Points A and B are also represented on the evolution curve of the heat exchange coefficient between the strip and the sprayed liquid, illustrated by the curve of the appended FIG. 5. The curve shows an increase in the heat exchange coefficient between the two critical points. Thus, at point B of martensitic transformation, a low initial thermal heterogeneity will be amplified by the increase in the heat exchange coefficient, thus leading to a significant risk of desynchronization of martensitic transformations and an associated heterogeneity in the distribution of internal stresses.

The evolution of the longitudinal stress at the edge of the strip represented by curve C1 in the appended FIG. 6, without taking into account the metallurgical transformation at point B, shows a compressive stress peak at the onset of cooling to 650° C., and at the thermal slope break at 150° C. on the cooling curve, corresponding to the decrease in the heat exchange coefficient at the end of the Leidenfrost transition zone.

Taking into account the metallurgical transformation at 450° C. by a disturbance of the thermal expansion coefficient at this point, illustrated by curve D2 of FIG. 3, results in a compressive stress peak at the martensitic transformation point and an increase of the tensile stress upstream of the martensitic transformation point as shown by curve C2 in the appended FIG. 6. This result highlights the opposing effects of the contraction of the strip during cooling, which causes tensile stresses, and the relative increase in volume that accompanies the metallurgical transformation, which causes compressive stress.

From the identification of the critical points, a second thermal profile is proposed with the same average cooling rate equal to 480° C./s, illustrated by curve T2 in the appended FIG. 7, the critical point C corresponding to the concomitance of the Leidenfrost temperature and the martensitic transformation temperature at 450° C.

This optimized thermal profile is obtained by a different adjustment of the 2 successive zones of the cooling section:

- a first zone with a length equal to % of the total length of the cooling section, for which the pressure is limited to 1 bar to delay the appearance of the Leidenfrost point,
- a second zone with a length equal to ¼ of the total length of the cooling section, for which the maximum pressure of 8 bar is applied.

Points A, B and C are also represented on the evolution curve of the heat exchange coefficient between the strip and the sprayed liquid, illustrated by curves H1 and H2 of the appended FIG. 8, highlighting, on curve H2, a reduction in the amplitude of variation of the heat exchange coefficient for a small variation in temperature of the strip in the martensitic transformation zone, in comparison with the slope observed at point B on curve H1.

Similarly, the evolution of the longitudinal stress at the edge of the strip represented by curve C2 in the appended FIG. 9 highlights a more favorable distribution of stresses along the strip, with an increase in the tensile stress upstream of the non-critical martensitic transformation point and a reduction in the compressive stress at the origin of buckling phenomena and risk of irreversible deformation, downstream of the martensitic transformation point.

Thus, the concomitance of the Leidenfrost temperature and the martensitic transformation temperature illustrated by point C in the appended FIG. 8, which induce internal stresses of opposite signs, that is to say, a contraction at the Leidenfrost point and an expansion at the metallurgical transformation point, allows a reduction of the amplitude of the internal stresses and the risk of associated unevenness defects.

Moreover, the position of the martensitic transformation point at a more favorable point of the evolution curve of the heat exchange coefficient reduces the risk of amplification of local coupled phenomena of thermal and metallurgical heterogeneity.

According to a second embodiment, for carbon steel composed of 0.25% Carbon, 1% Manganese and 1% Silicon, annealed at a temperature above 850° C. for complete austenitization, cooled from 650 to 100° C. in a rapid cooling section by spraying with an average cooling rate of about 100° C./s for a strip moving at 15 m/min, 2 slope breaks may be observed on the evolution curve of the thermal expansion coefficient, a first break at 550° C. corresponding to the bainitic transformation and a second at 400° C. corresponding to the martensitic transformation of the residual austenite, illustrated schematically by the curve of the appended FIG. 10, corresponding to the total martensitic transformation of the austenitic phase.

The thermal profile obtained for uniform spraying along the length of the product, illustrated by curve T1 in the appended FIG. 11, highlights 3 critical points, the Leidenfrost transition point represented by point A at 600° C., the first metallurgical transformation point represented by point B at 550° C. and the second metallurgical transformation point represented by point C at 400° C.

The thermal profile obtained for an optimized adjustment of the cooling distribution according to:

- a first zone with a length equal to ¾ of the total length of the cooling section, for which the pressure is limited to 0.5 bar,
- a second zone with a length equal to ¼ of the total length of the cooling section, for which the maximum pressure of 8 bar is applied.

Curve T2 in the appended FIG. 11 illustrates, with highlighting of 3 critical points, the first metallurgical transformation point represented by the point D shifted to 560° C. to take account of the reduction in cooling rate, the second metallurgical transformation point represented by point F shifted to 410° C. and the Leidenfrost transition point represented by point E at 500° C. at an intermediate temperature between the 2 metallurgical transformation points.

Points A, B, C, D, E and F are also represented on the evolution curves of the heat exchange coefficient between the strip and the sprayed liquid, illustrated by curves H1 and H2 of the appended FIG. 12, corresponding respectively to the thermal profiles T1 and 12 of the attached FIG. 11, highlighting the amplitude of variation of the heat exchange coefficient for a small variation in temperature of the strip at the metallurgical transformation points.

The comparison of the longitudinal stresses at the edge of the strip calculated under these assumptions, illustrated by curves C1 and 02 on the graph of the appended FIG. 13 corresponding respectively to the thermal profiles T1 and T2 of FIG. 11, highlights an optimization of the distribution of the stresses along the strip, with a reduction in the compressive stress, at the 2 metallurgical transformation points and downstream of the last transformation point.

The invention is not limited to the examples that have just been described, and numerous modifications may be made to these examples without departing from the scope of the invention. In addition, the various features, forms, variants, and embodiments of the invention may be grouped together in various combinations as long as they are not incompatible or mutually exclusive.

The invention claimed is:

1. A method for reducing unevenness defects of a strip subjected to cooling by spraying a fluid along a cooling zone of a continuous heat treatment line, said cooling zone having means for adjusting a cooling intensity along the cooling zone, the method comprising:

determining, before the strip is subjected to the cooling along the cooling zone, a thermal profile to be applied to the strip along the cooling zone to cause, at a first portion of the strip, substantial concomitance between (i) a predetermined critical strip temperature, called Leidenfrost temperature, and (ii) a first temperature at which a change in metallurgical structure of the strip is initiated;

cooling, at a first cooling intensity, at a first point along the cooling zone, and according to the thermal profile, the first portion of the strip to the predetermined critical strip temperature;

cooling, at a second cooling intensity, at a second point downstream of the first point along the cooling zone, and according to the thermal profile, the first portion of the strip to the first temperature; and adjusting the second cooling intensity at the second point, including adjusting one or more of a flow rate of the fluid, a flow pressure of the fluid, and an amount of time the fluid is sprayed onto the strip at the second point;

wherein the thermal profile is determined by:

a minimum cooling rate to achieve desired metallurgical structure changes;

a metallurgical transformation temperature for achieving desired metallurgical structure changes;

thermal critical points for achieving the Leidenfrost temperature; and conditions for initiating adjusting the thermal profile.

2. The method according to claim 1, further comprising adjusting the cooling intensity along the cooling zone according to a minimum cooling rate to achieve a selected metallurgical structure change.

3. The method according to claim 1, further comprising adjusting the cooling intensity along the cooling zone such that a change in metallurgical structure begins at a selected temperature.

4. The method according to claim 1, further comprising adjusting the cooling intensity along the cooling zone such that the Leidenfrost temperature is equal to a predetermined value.

5. The method according to claim 1, further comprising adjusting the cooling intensity along the cooling zone such that either (a) the Leidenfrost temperature is equal to a metallurgical structure change onset temperature, or (b) the Leidenfrost temperature is at a temperature between a temperature at the onset of a first metallurgical structure change and a temperature at the onset of a last metallurgical structure change.

6. The method according to claim 1, wherein the change in metallurgical structure comprises a phase transformation from austenite to martensite, and wherein the cooling intensity is adjusted such that the Leidenfrost temperature is within a temperature range of plus or minus 50° C. from the martensitic structure change onset temperature.

7. The method according to claim 1, wherein the cooling intensity is adjusted along the cooling zone so that the Leidenfrost temperature is at a temperature midway between a temperature at the onset of a first metallurgical structure change and a temperature at the onset of a last metallurgical structure change.

8. The method according to claim 1, the fluid comprises a mixture of gas and liquid.

9. The method according claim 1, wherein the fluid is non-oxidizing to the strip.

10. The method according claim 1, wherein the first cooling intensity is different than the second cooling intensity.

* * * * *